US005535765A

United States Patent [19]

Takashima

[11] Patent Number: 5,535,765

[45] Date of Patent: Jul. 16, 1996

[54] HAIR BINDER

[76] Inventor: Yoshiyuku Takashima, 20-35 Ougigaoka, Nonoichi-machi, Ishikawa-gun, Ishikawa 921, Japan

[21] Appl. No.: 377,233

[22] Filed: Jan. 24, 1995

[30] Foreign Application Priority Data

Sep. 30, 1994 [JP] Japan ..... 6-261961

[51] Int. Cl.[6] ..... A45D 8/22; A45D 8/28

[52] U.S. Cl. ..... 132/273; 132/279; 24/17 B; 24/300

[58] Field of Search ..... 132/273, 279, 132/275; 24/17 B, 300

[56] References Cited

U.S. PATENT DOCUMENTS 1,533,380 4/1925 Burkhart ..... 132/273

3,842,849 10/1974 Goodman ..... 132/273

4,785,834 11/1988 Gonzalez ..... 132/275

FOREIGN PATENT DOCUMENTS 22096 of 1901 United Kingdom ..... 132/273

*Primary Examiner*—John G. Weiss

*Attorney, Agent, or Firm*—Nikaido, Marmelstein, Murray & Oram

[57] ABSTRACT

A hair binder for binding a bunch of long hair includes an elastic hair band, a pair of frames joined at proximal ends thereof for opening and closing relative to each other, the frames forming a circle when closed, a first engaging structure disposed at distal ends of the pair of frames for engaging opposite ends of the band, and a second engaging structure disposed at the proximal ends for engaging intermediate positions of the band when the frames are opened, and releasing the intermediate positions when the frames are closed.

15 Claims, 14 Drawing Sheets

HAIR BINDER

BACKGROUND OF THE INVENTION

1. Field of the Invention

This invention relates to a relatively small and handy hair binder for binding a bunch of long hair simply and uniformly.

2. Description of the Related Art

Referring to FIG. 1, it has been conventional practice to use an elastic band 1 formed into multiple rings to bind a bunch of long hair LH. The bunch of long hair LH is passed through the rings of elastic band 1 to be bound near its root end.

In the conventional practice, however, it is a troublesome operation to pass the bunch of long hair LH through the rings of elastic band 1. Further, long hair LH could easily become ruffled during its binding, and end up in a non-uniform finish.

SUMMARY OF THE INVENTION

This invention has been made having regard to the state of the art noted above, and its object is to provide a hair binder which allows a bunch of long hair to be bound easily and uniformly.

The above object is fulfilled, according to this invention, by a hair binder for binding a bunch of long hair, comprising an elastic hair band; a pair of frames joined at proximal ends thereof for opening and closing relative to each other, the frames forming a circle when closed; a first engaging structure disposed at distal ends of the pair of frames for engaging opposite ends of the band; and a second engaging structure disposed at the proximal ends for engaging intermediate positions of the band when the frames are opened, and releasing the intermediate positions when the frames are closed.

For binding a bunch of long hair, the frames are opened wide about the joined proximal ends thereof. In this state, the elastic hair band extends linearly as engaged by the first engaging structure disposed at the distal ends of the frames. Then, the frames are placed adjacent a position to be bound of the long hair, and closed gradually.

At this time, the elastic band becomes V-shaped as a whole, with intermediate positions thereof engaging the second engaging structure at the proximal ends of the frames. The bunch of long hair is held in the V-shaped elastic band. As the frames are closed further to bring the opposite ends of the elastic band adjacent each other, the elastic band becomes disengaged from the second engaging structure, whereby the band elastically contracts to bind the bunch of long hair.

As described above, the pair of frames are moved from open position to closed position to bundle and bind a bunch of long hair with ease. There is no need to carry out an operation to pass the bunch of long hair through a ring of elastic band, so that the hair is bound uniformly and neatly without becoming ruffled.

Preferably, the second engaging structure comprises a pivotal axis projecting from the proximal ends of the frames and connected to one of the frames for allowing opening and closing of the frames, the pivotal axis having projecting opposite ends thereof defining slant surfaces, respectively, for allowing the intermediate positions of the band to slip out of engagement therewith.

With the closing movement of the frames, the pivotal axis rotates at the proximal ends of the frames while engaging the intermediate positions of the band. As the frames are closed further, the intermediate positions of the elastic band slip along and off the slant surfaces of the pivotal axis. Consequently, the band elastically contracts itself to bind the bunch of long hair.

According to this second engaging structure, the intermediate positions of the band become free as a result of rotation of the pivotal axis occurring with closure of the frames. This realizes a hair binder having a relatively simple construction.

It is also preferred that the second engaging structure includes engaging pins each mounted with a coil spring in a stepped bore formed in a friction surface of the proximal end of one of the frames, with a distal end of each engaging pin being projectable from an outer surface of one of the frames, the friction surface of the proximal end of the other frame defining a recess for receiving a proximal end of the engaging pin when the frames are closed.

When the frames are open, the engaging pin of each frame is pushed by the friction surface of the other frame, so that the distal end of this pin projects from the first-mentioned frame. When the frames are open, the intermediate positions of the band are engaged by these engaging pins. As the frames are closed, the proximal end of each engaging pin falls into the recess of the other frame, whereby the distal end of this engaging pin retracts into the associated frame to release the intermediate position of the elastic band. Thus, the band elastically contracts itself to bind the bunch of long hair.

According to this second engaging structure, the intermediate positions of the band become free as a result of the engaging pins retracting into the frames with closure of the frames. This realizes a hair binder having a relatively simple construction.

Preferably, the first engaging structure is constructed for removably securing at least one end of the band and for allowing adjustment of band length.

This engaging structure removably secures at least one end of the band. One end of the band may be attached to this structure with a margin to shorten the band. Thus, the elasticity of the band may be adjusted according to a bulk of long hair to be bound.

According to this first engaging structure, at least one end of the band is removably attached to the first engaging structure. Consequently, the band length may be adjusted simply according to a bulk of long hair to be bound.

Further, it is preferred that the band is ring-shaped with a hook attached to a position thereof, the first engaging structure including grooves formed in the frames for loosely engaging the position of the band to which the hook is attached and a position of the band opposed to the hook, respectively, the hook engaging the position of the band opposed thereto to separate the band and the frames from each other when the frames are closed.

When the frames are open, the elastic band is engaged at intermediate positions thereof by the second engaging structure. As the frames are closed, the hook on the elastic band as engaged by one part (groove) of the first engaging structure on one frame catches an the opposite position of the band engaged by the part (groove) of the first engaging structure on the other frame. At the same time, the intermediate positions of the band are released from the second engaging structure, thereby binding the hair. When the frames are opened in this state, the hook position and opposite position of the elastic band become disengaged from the grooves. As a result, only the frames are removed from the bunch of long hair.

This construction allows the band and frames to separate from each other after the bunch of long hair is bound, so that the frames are removed. This is advantageous when the user does not wish to wear the frames on her hair.

In a further aspect of this invention, a hair binder for binding a bunch of long hair comprises an elastic hair band in ring form; a hook attached to a position of the band; a pair of frames for presenting an inverted U-shape when closed; a first engaging structure including grooves formed at distal ends of the pair of frames for loosely engaging the position of the band to which the hook is attached and a position of the band opposed thereto, the hook engaging the position of the band opposed thereto to separate the band and the frames from each other; a pair of support members for supporting proximal ends of the frames, respectively, to be pivotable open and close about a predetermined pivoting center; and a second engaging structure disposed at the pivoting center for engaging intermediate positions of the band when the frames are opened, and releasing the intermediate positions when the frames are closed.

For binding a bunch of long hair, the distal ends of the frames are opened wide apart by a manual pressure applied to opposite sides of the support members. In this state, the elastic band is engaged by the first engaging structure disposed at the distal ends of the frames, to be V-shaped with intermediate positions thereof engaged by the second engaging structure. The user moves the open frames over the bunch of long hair, and relaxes the force applied to the support members. Then, the distal ends of the frames are closed by the V-shaped elastic band. At this time, the hook on the elastic band as engaged by one part (groove) of the first engaging structure on one frame catches an the opposite position of the band engaged by the part (groove) of the first engaging structure on the other frame. At the same time, the intermediate positions of the band are released from the second engaging structure, thereby binding the hair. When the support members are pressed in this state, the hook position and opposite position of the elastic band become disengaged from the grooves. As a result, the elastic band elastically contracts itself to bind the bunch of long hair.

According to this hair binder, the distal ends of the frames are opened simply by pressing the two support members, thereby to facilitate attachment of the hair band to the frames. With the band attached, the frames may be closed only by relaxing the force applied to the two support members, to facilitate hair binding.

Preferably, the pair of support members include flexible support mechanisms for flexibly supporting the frames, respectively.

By extending the frames from the support members, the distal ends of the frames may have a large spacing therebetween when opened. This allows even a bulky bunch of hair to be received through the spacing between the distal ends to contact the elastic band of the hair binder.

Preferably, each of the flexible support mechanisms includes a guide groove of T-shaped section formed in one of the support members, flat-head mounting screws slidable along the guide groove and connected to one of the frames, and a position setter for restraining one of the frames from sliding along the guide groove.

Further, the frames may include a hook engaging mechanism for causing the hook to engage the position of the band opposed thereto when the frames are closed.

The hook engaging mechanism causes the hook to engage reliably the position of the band opposed thereto, thereby binding the bunch of long hair reliably.

Preferably, the hook engaging mechanism includes a hook engaging member having a recessed hook engaging portion for engaging the hook, a pivotal axis for allowing the hook engaging portion to move to a position opposed to the hook, biasing means for biasing the hook engaging portion above a position of the band opposed to the hook, and a drive member for causing a pivotal movement of the hook engaging member.

The second engaging structure may comprise a pivotal axis projecting from the support members at the pivoting center and connected to one of the support members for allowing opening and closing of the frames, the pivotal axis having projecting opposite ends thereof defining slant surfaces, respectively, for allowing the intermediate positions of the band to slip out of engagement therewith.

Preferably, the second engaging structure includes engaging pins each mounted with a coil spring in a stepped bore formed in a friction surface adjacent the pivoting center of one of the support members, with a distal end of each engaging pin being projectable from an outer surface of one of the frames, the friction surface of the other support member defining a recess for receiving a proximal end of the engaging pin when the frames are closed.

The support members may include a frame closing mechanism for closing the distal ends of the frames in a normal state.

The frame closing mechanism may include an inverted V-shaped leaf spring with a middle portion thereof placed at the pivoting center of the support members, and projections formed on the support members to engage opposite ends of the leaf spring, respectively.

It is preferred that the support members define finger receiving openings, respectively.

The support members may be held with a thumb and a finger placed in the support openings, such that the thumb and finger hold the support members steadily without slipping therefrom. Thus, the two frames may be opened reliably and held steadily for applying the band to a bunch of long hair.

BRIEF DESCRIPTION OF THE DRAWINGS

For the purpose of illustrating the invention, there are shown in the drawings several forms which are presently preferred, it being understood, however, that the invention is not limited to the precise arrangements and instrumentalities shown.

DETAILED DESCRIPTION OF THE PREFERRED EMBODIMENTS

Preferred embodiments of this invention will be described in detail hereinafter with reference to the drawings.

First Embodiment

Figure 1:
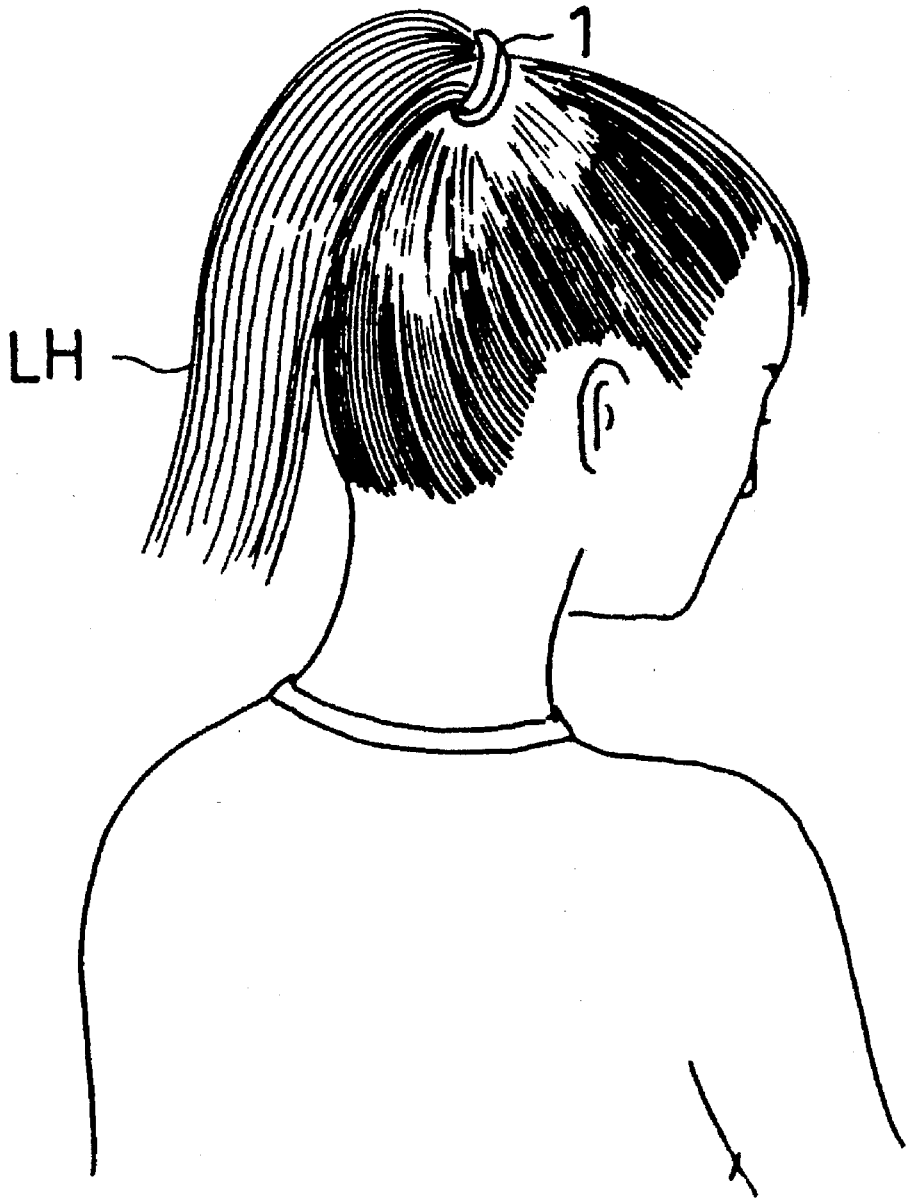
Fig.1 (PRIOR ART)
FIG. 1 is an explanatory view of the prior art.
Figure 2:
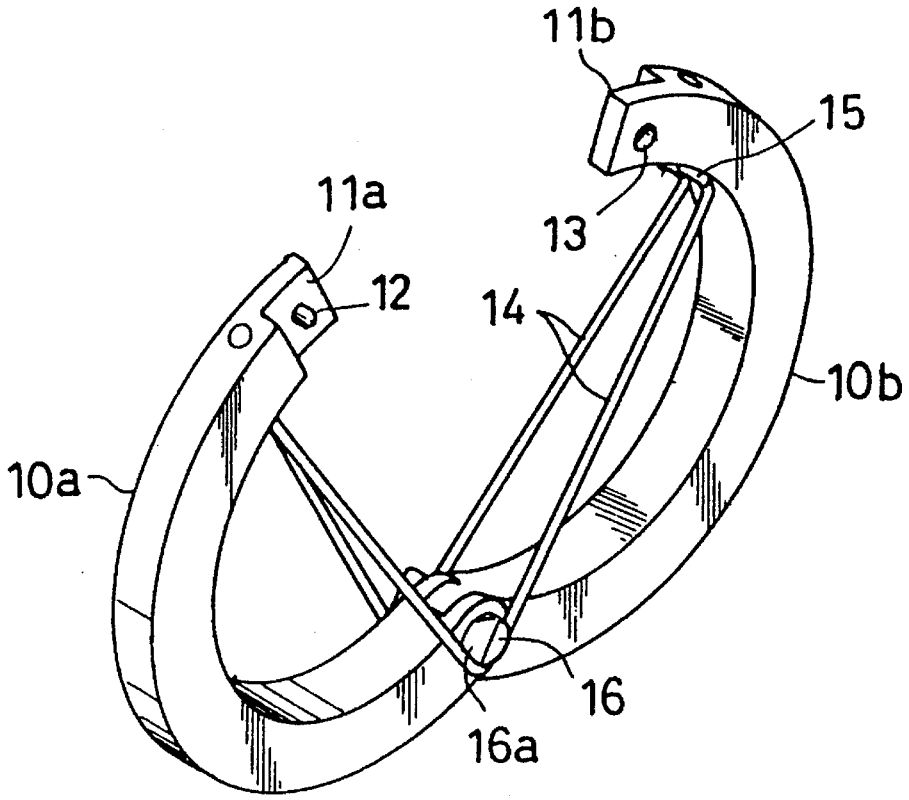
FIG. 2 is a perspective view of a hair binder in a first embodiment of this invention.

FIG. 2 is a perspective view showing a hair binder in a first embodiment of this invention.

References 10*a* and 10*b* in FIG. 2 denote C-shaped frames joined at proximal ends thereof to be pivotable relative to each other and to form a circle when closed. The frames 10*a* and 10*b* have an outside diameter in the order of 30 to 50 mm, and are formed of a relatively light material such as plastic or aluminum to be handy to carry. The frames 10*a* and 10*b* have stepped, distal engaging ends 11*a* and 11*b*. The engaging end 11*a* has a projection 12, while the engaging end 11*b* has a small bore 13 for receiving the projection 12.

An elastic band 14 extending in duplex is secured at opposite ends thereof to inner walls in distal regions of the frames 10*a* and 10*b* through fittings 15. The elastic band 14 corresponds to a hair band of this invention, while the fittings 15 correspond to a first engaging structure. The band is not limited to a rubber band, but may be a coil spring covered with an elastic sheath.

A pivotal axis 16 is disposed at the joint between the frames 10*a* and 10*b* for allowing the frames 10*a* and 10*b* to open and close relative to each other. The pivotal axis 16 is connected to one of the frames 10*b*, with the other frame 10*a* loose fitting on the pivotal axis 16. The pivotal axis 16 has opposite ends projecting from the frames 10*a* and 10*b*, and each defining a slant surface 16*a*.

The operation of the hair binder in the first embodiment will be described with reference to FIGS. 3 through 5.

Figure 3:
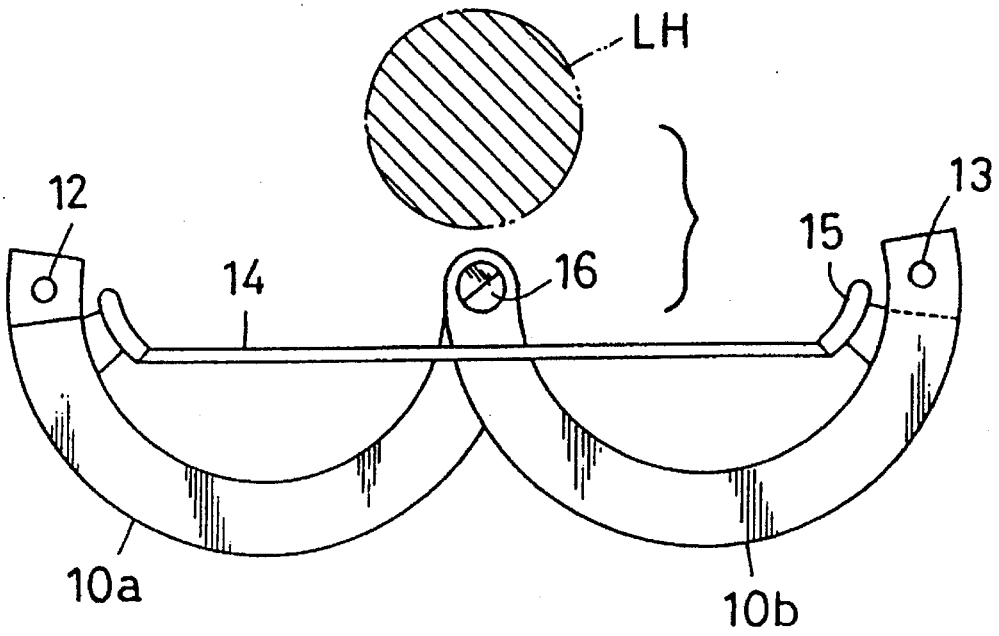
FIG. 3 is an explanatory view of the operation of the hair binder in the first embodiment.

For binding a bunch of long hair LH, the frames 10*a* and 10*b* are opened wide apart about the joint as shown in FIG. 3. In this state, the elastic band 14 extends linearly as engaged by the fittings 15 in the distal regions of the frames 10*a* and 10*b*. Then, the joint of the frames 10*a* and 10*b* is placed adjacent a position to be bound of long hair LH, and the frames 10*a* and 10*b* are closed gradually.

Figure 4:
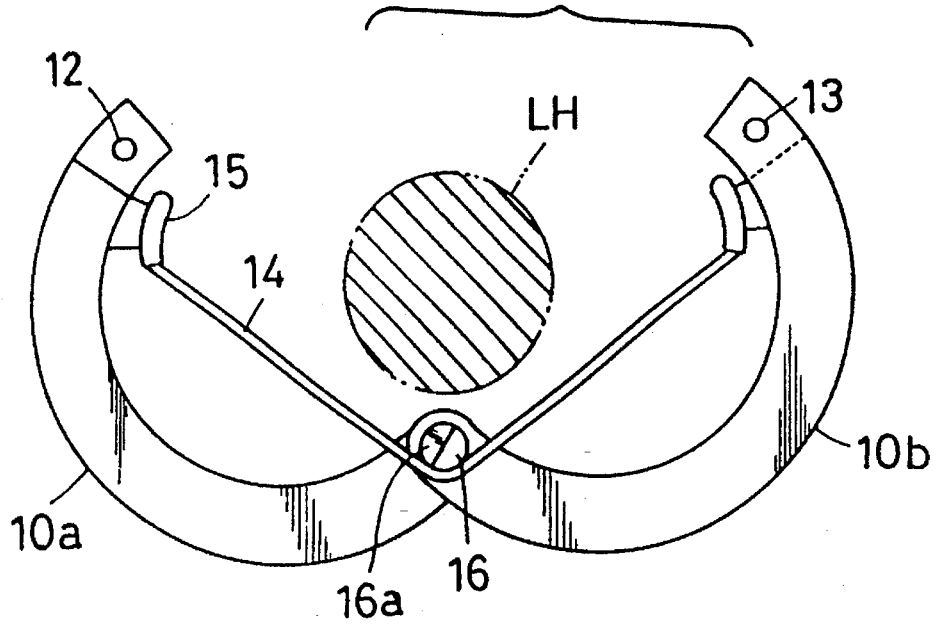
FIG. 4 is an explanatory view of the operation of the hair binder in the first embodiment.
Figure 5:
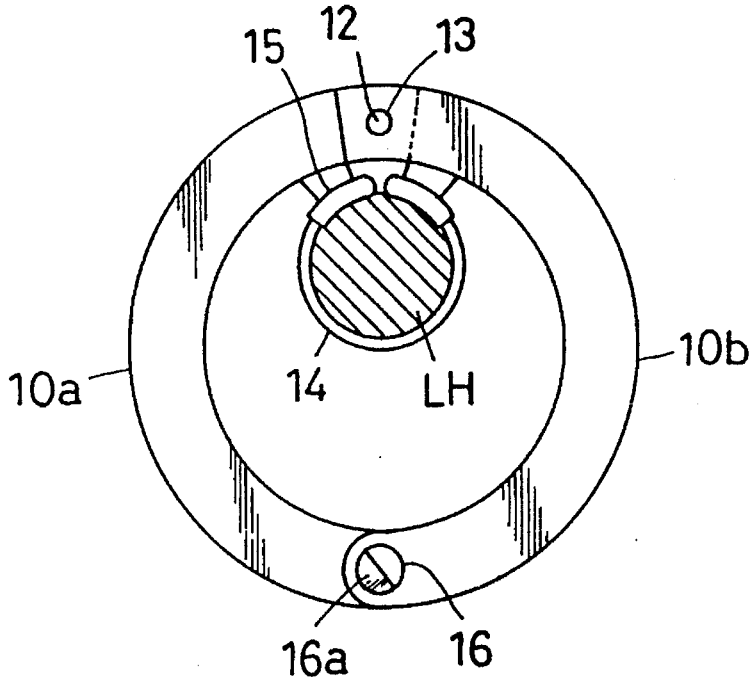
FIG. 5 is an explanatory view of the operation of the hair binder in the first embodiment.

As the frames 10*a* and 10*b* are closed, as shown in FIG. 4, the elastic band 14 becomes V-shaped as a whole, with intermediate positions thereof engaging portions of the pivotal axis 16 not defining the slant surfaces 16*a*. The bunch of long hair LH is held in the V-shaped elastic band 14.

As the frames 10*a* and 10*b* are closed further to bring the opposite ends of the elastic band 14 adjacent each other, the slant surfaces 16*a* of the pivotal axis 16 having rotated with the closing action of the frames 10*a* and 10*b* contact the elastic band 14. Consequently, the elastic band 14 stretched into the V shape slips off the slant surfaces 16*a* under its elastic restoring force, and elastically contracts to bind the bunch of long hair LH as shown in FIG. 5. At approximately the same time, the projection 12 of the frame 10*a* fits into the small bore 13 of the frame 10*b* to join the frames 10*a* and 10*b* into a circular shape.

According to this embodiment, as described above, the closure of the pair of frames 10*a* and 10*b* causes the elastic band 14 to bundle and bind the bunch of long hair LH. Thus, the bunch of long hair LH may be bound easily and uniformly. In this embodiment, the frames 10*a* and 10*b* and elastic band 14 are inseparable. The frames 10*a* and 10*b* may be colored and/or patterned as appropriate to be used as an ornamental piece.

Second Embodiment

Figure 6:
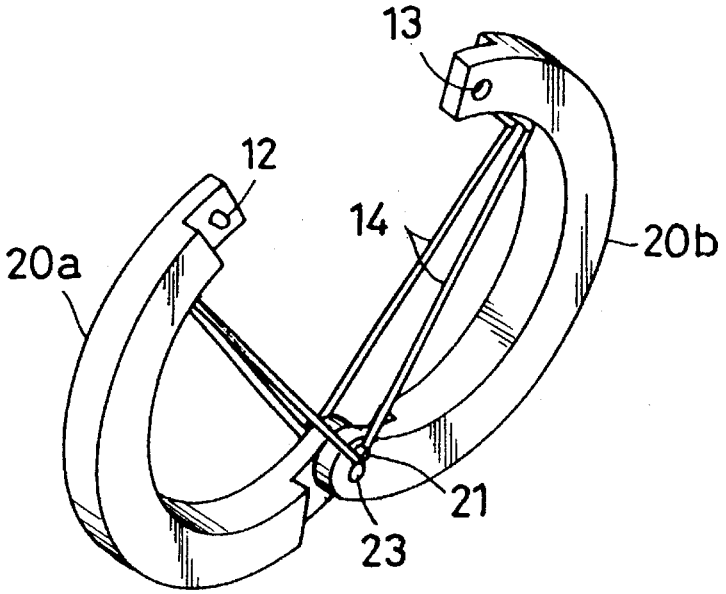
FIG. 6 is a perspective view of a hair binder in a second embodiment of this invention.

FIG. 6 is a perspective view of a hair binder in a second embodiment.

The characterizing feature of this embodiment lies in that each of frames 20*a* and 20*b* includes an engaging pin 21 extendible from and retractable to a surface thereof with opening and closing of the frames 20*a* and 20*b*. The engaging pins 21 act as a second engaging structure for engaging intermediate positions of the elastic band 14. In FIG. 6, like references are used to identify like parts in FIG. 2 which are the same as in the first embodiment and will not be described again.

Figure 7:
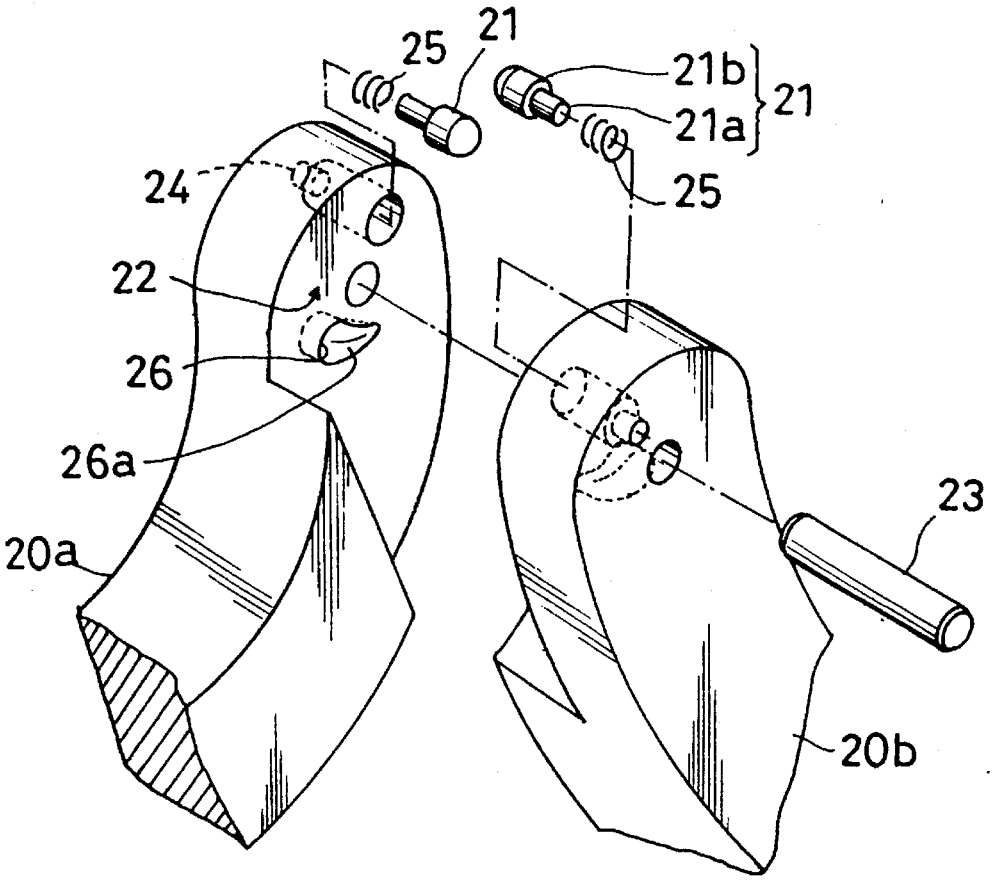
FIG. 7 is an enlarged and exploded perspective view of a principal portion of the hair binder in the second embodiment.
Figure 8:
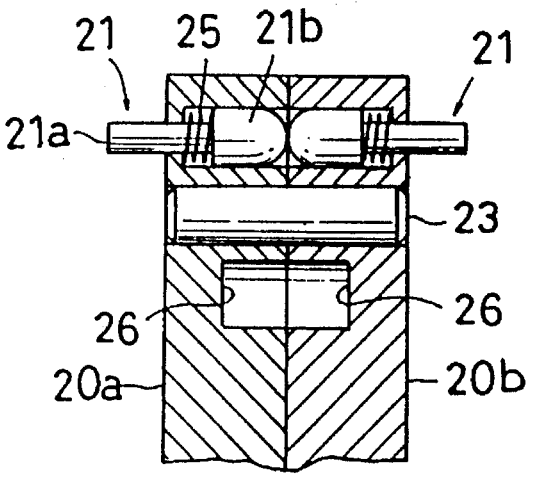
FIG. 8 is a sectional view of a principal portion of the hair binder in the second embodiment.

A structure around the engaging pins 21 will be described with reference to FIGS. 7 and 8.

The frames 20*a* and 20*b* have proximal ends stepped to define friction surfaces 22 in contact with each other and pivotably interconnected through a coupling pin 23. Each friction surface 22 has a stepped bore 24, and one of the engaging pins 21 is fitted with a compression coil spring 25 in the stepped bore 24. The engaging pin 21 has a small diameter portion 21*a* extending through the stepped bore 24 to be projectable from an outer surface of the frame 20*a* or 20*b*. A large diameter proximal portion 21*b* of the engaging pin 21 is formed hemispherical. Each friction surface 22 includes a recess 26 defined in a position substantially opposed to the stepped bore 24 across a pivotal axis to receive the proximal portion 21*b* of the opposite engaging pin 21. A slant groove 26*a* is formed around the recess 26 to guide the proximal portion 21*b* of the engaging pin 21.

Figure 9A:
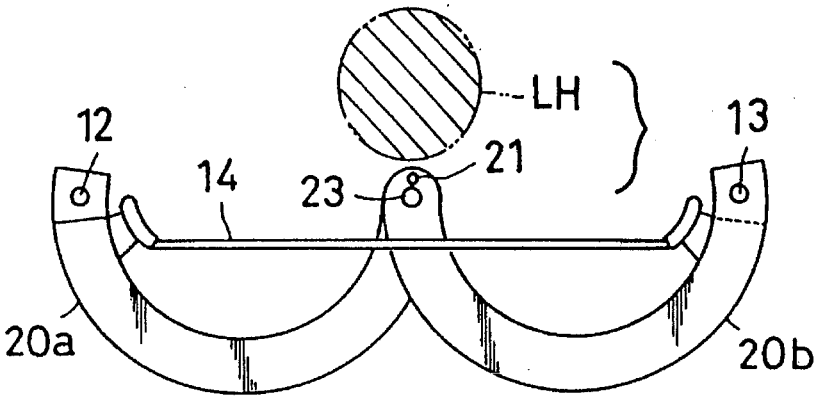
FIGS. 9A and 9B are explanatory views of the operation of the hair binder in the second embodiment.

The operation of the hair binder in the second embodiment will be described with reference to FIGS. 9A and 9B through 11A and 11B. FIGS. 9A, 10A and 11A are front views, and FIGS. 9B, 10B and 11B are side views.

Figure 9B:
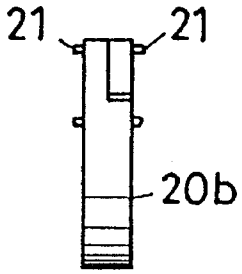
Figure 10A:
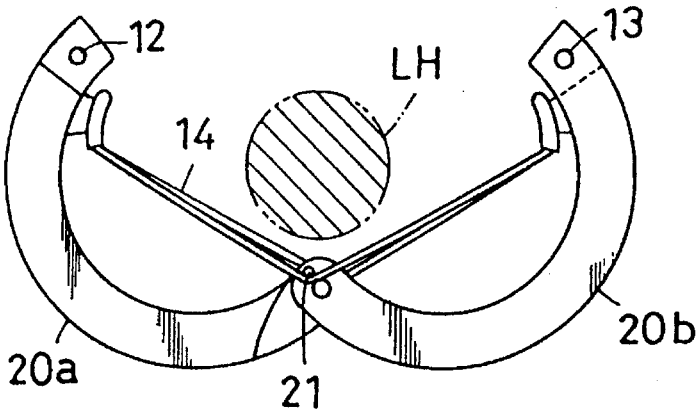
FIGS. 10A and 10B are explanatory views of the operation of the hair binder in the second embodiment.

Referring to FIGS. 9A and 9B, when the frames 20*a* and 20*b* are wide open, the elastic band 14 extends linearly as in the first embodiment. The engaging pin 21 of each frame 20*a* or 20*b* is in contact with the friction surface 22 of the other frame, so that the small diameter portion 21*a* projects from the frame 20*a* or 20*b* against the elastic force of the coil spring 25.

Figure 10B:
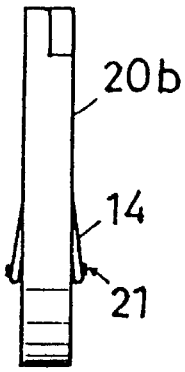
Figure 11A:
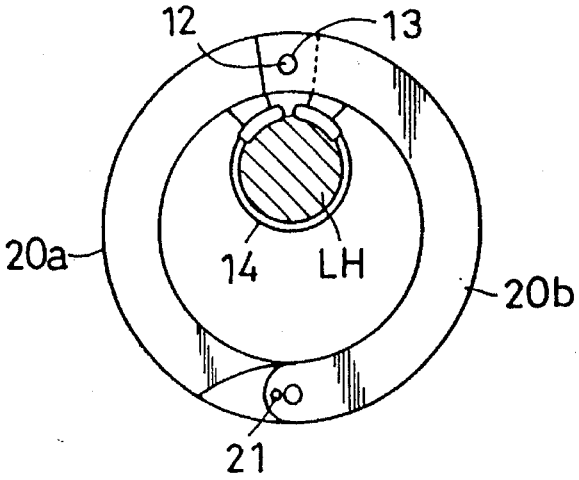
FIGS. 11A and 11B are explanatory views of the operation of the hair binder in the second embodiment.
Figure 11B:
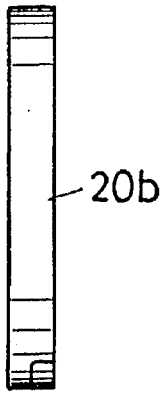

As the frames 20*a* and 20*b* are closed, as shown in FIGS. 10A and 10B, the elastic band 14 becomes V-shaped as a whole with intermediate positions thereof engaged with the engaging pins 21, to bundle a bunch of long hair LH.

As the frames 20*a* and 20*b* are closed further, the proximal portion of the engaging pin 21 of each frame 20*a* or 20*b* falls into the recess 26 of the other frame, and the small diameter portion 21*a* of the engaging pin 21 retracts into the stepped bore 24. Consequently, the elastic band 14 becomes disengaged from the engaging pins 21, and elastically contracts itself to bind the bunch of long hair LH as shown in FIGS. 11A and 11B. At approximately the same time, the frames 20*a* and 20*b* are joined to form a circle as in the first embodiment.

Third Embodiment

Figure 12:
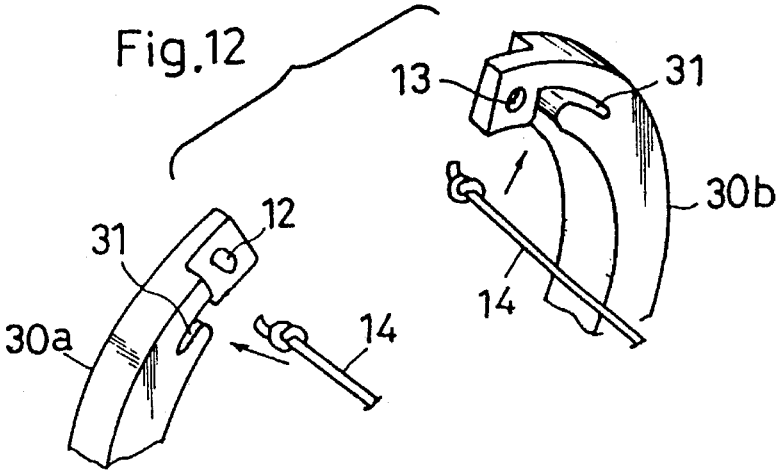
FIG. 12 is a perspective view of a principal portion of a hair binder in a third embodiment of this invention.

FIG. 12 is a perspective view showing a principal portion of a hair binder in a third embodiment.

The characterizing feature of this embodiment lies in the first engaging structure provided in distal regions of frames 30*a* and 30*b* for anchoring the opposite ends of elastic band 14. The other aspects are the same as in the first embodiment (or second embodiment), and will not be described again.

The first engaging structure here includes narrow L-shaped cutouts 31 formed in the distal regions of frames 30*a* and 30*b*. The opposite ends of the elastic band 14 are removably fitted and secured in these cutouts 31. Depending on a bulk of hair to be bound, at least one end of the elastic band 14 may be attached to the cutout 31 with a margin. In this way, the elastic band 14 may be shortened to adjust its binding force.

Fourth Embodiment

In the preceding embodiments, the frames and elastic band are inseparable in binding a bunch of long hair LH. This embodiment allows frames and elastic band to be separated from each other.

Figure 13:
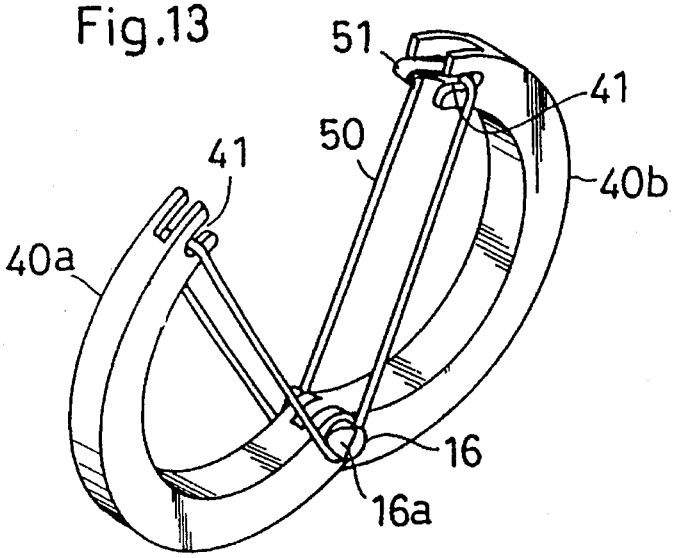
FIG. 13 is a perspective view of a hair binder in a fourth embodiment of this invention.

FIG. 13 is a perspective view of a hair binder in this embodiment.

The frames 40*a* and 40*b* have grooves 41 defined in the distal ends thereof to act as the first engaging structure for loosely engaging an elastic band 50 in ring form. The second engaging structure at the proximal ends of the frames 40*a* and 40*b* comprises the same pivotal axis 16 defining slant surfaces 16*a* as described in the first embodiment. Alternatively, the engaging pin 21 described in the second embodiment may be employed to act as the second engaging structure.

Figure 14:
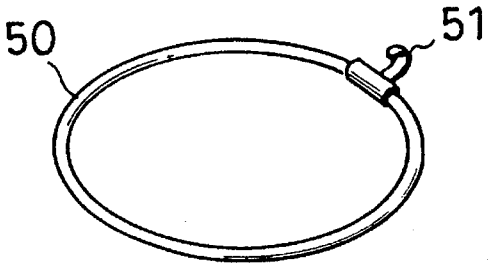
FIG. 14 is a perspective view of an elastic band.

As shown in FIG. 14, a hook 51 is attached to a position of the elastic band 50 in ring form. The position to which the hook 51 is attached and a position of the elastic band 50 opposed thereto are engaged in the respective grooves 41.

The operation of the hair binder in this embodiment will be described with reference to FIGS. 15 through 18.

Figure 15:
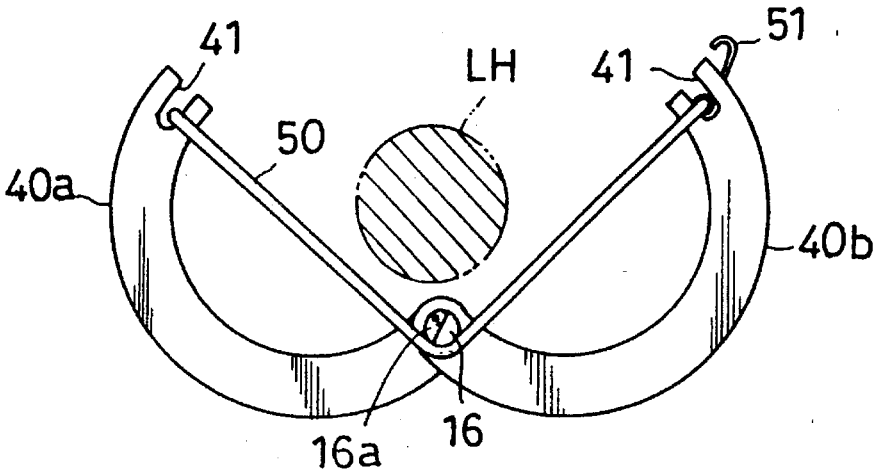
FIG. 15 is an explanatory view of the operation of the hair binder in the fourth embodiment.

FIG. 15 shows the frames 40*a* and 40*b* gradually closed from a wide open state. The elastic band 50 is engaged at intermediate positions thereof by the pivotal axis 16.

Figure 16:
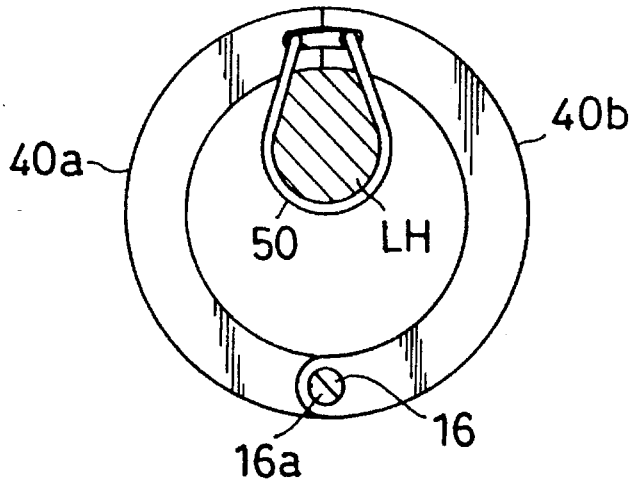
FIG. 16 is an explanatory view of the operation of the hair binder in the fourth embodiment.
Figure 17:
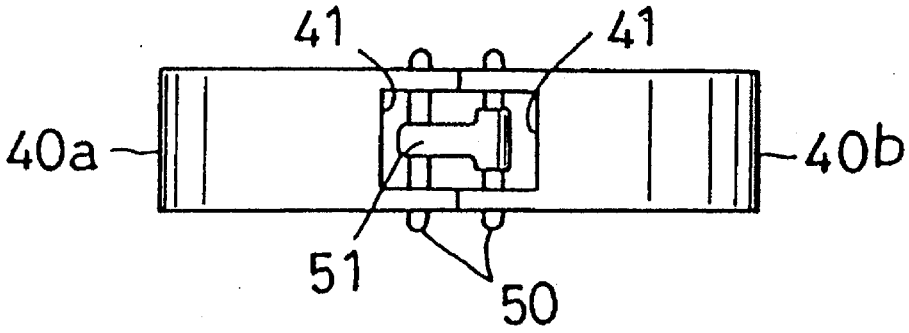
FIG. 17 is an explanatory view of the operation of the hair binder in the fourth embodiment.
Figure 18:
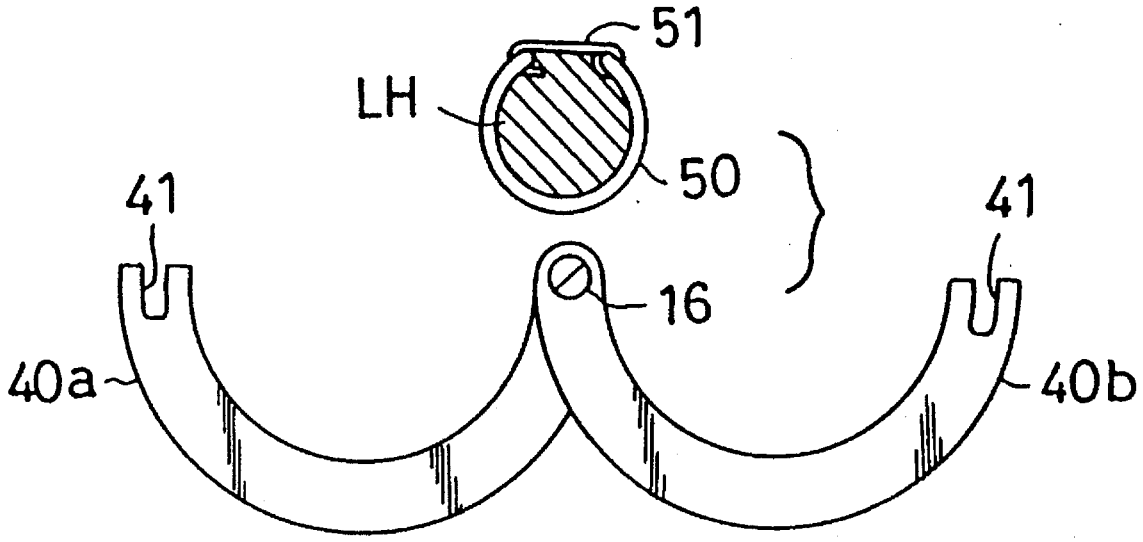
FIG. 18 is an explanatory view of the operation of the hair binder in the fourth embodiment.

When the frames 40*a* and 40*b* are completely closed, the hook 51 on the elastic band 50 catches the opposite position of the elastic band 50 as shown in the front view of FIG. 16 and plan view of FIG. 17. In this state, the frames 40*a* and 40*b* may be opened, whereby the opposite positions of the elastic band 50 become disengaged from the grooves 41, separating the elastic band 50 from the frames 40*a* and 40*b* as shown in FIG. 18.

This embodiment allows the elastic band 50 and frames 40*a* and 40*b* to separate from each other after a bunch of long hair is bound, which is of advantage when the user desires to wear only the elastic band 50 on her hair.

This invention is not limited to the foregoing embodiments, but may be modified as follows:

(1) In each of the foregoing embodiments, the pair of frames present a circular shape when closed. Instead, the frames may form a square or hexagon when closed.

(2) The projection 12 and small bore 13 used for joining the distal ends of the frames may be replaced by magnets embedded in the distal ends.

Fifth Embodiment

Figure 19:
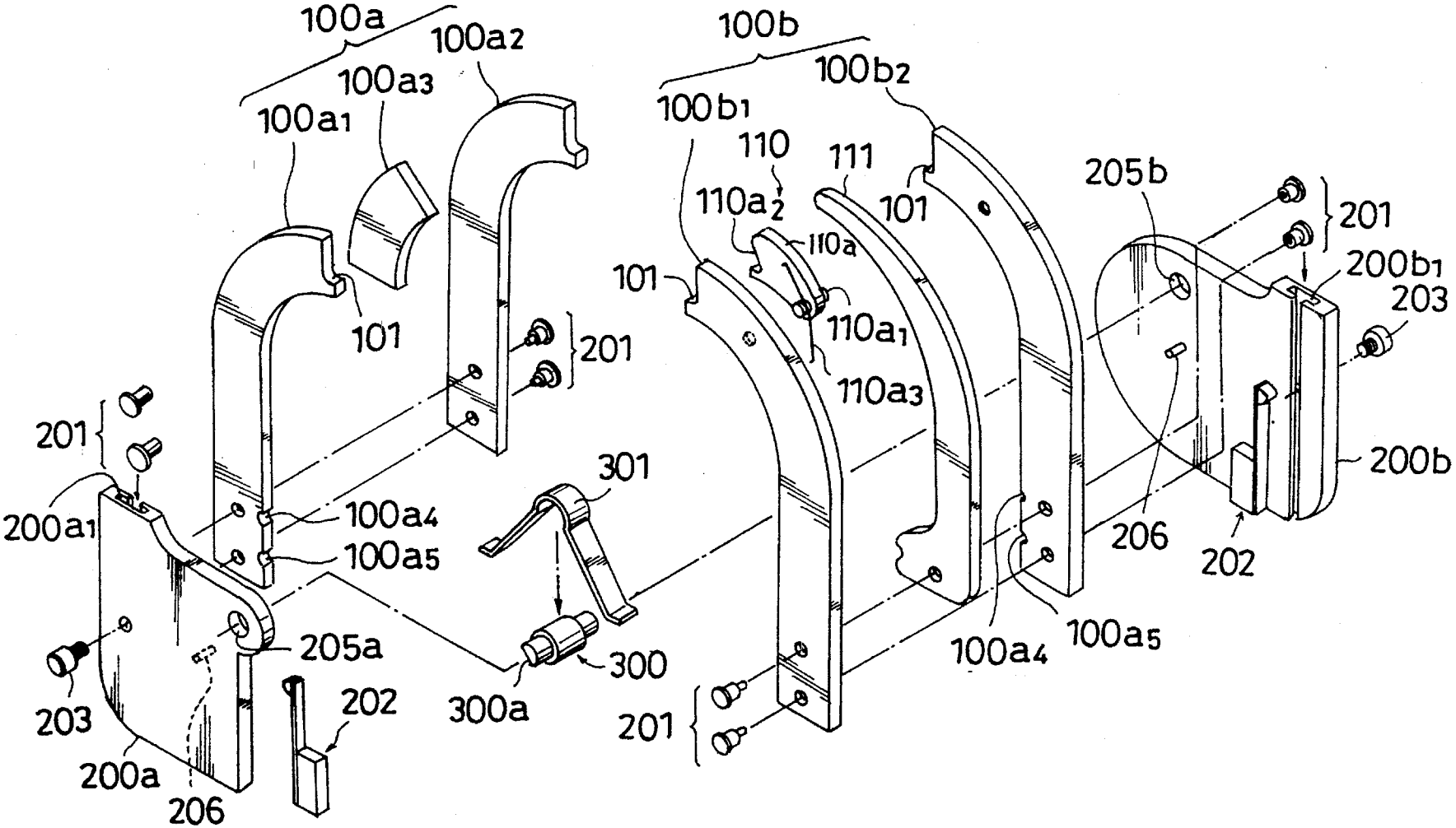
FIG. 19 is an exploded perspective view of a hair binder in a fifth embodiment of this invention.
Figure 20:
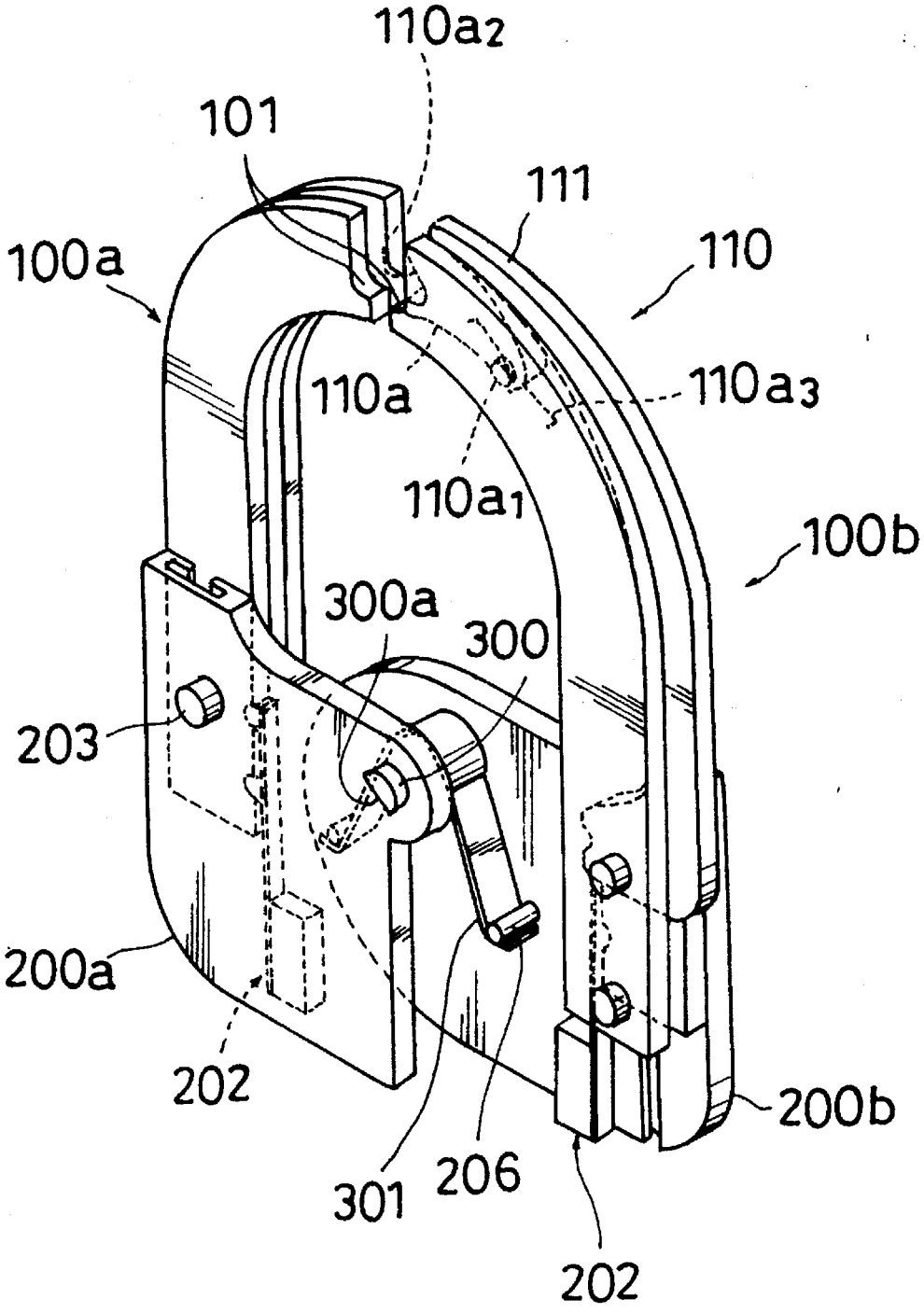
FIG. 20 is a perspective view of the hair binder in the fifth embodiment.

Reference is made to FIGS. 19 and 20. FIG. 19 is an exploded perspective view showing a hair binder in a fifth embodiment, and FIG. 20 is a perspective view thereof.

References 100*a* and 100*b* in these figures denote inverted U-shaped frames curved inwardly. The frame 100*a* includes two plate members $\mathbf{100}a_1$ and $\mathbf{100}a_2$, and a spacer $\mathbf{100}a_3$ for maintaining a predetermined spacing therebetween. The plate member $\mathbf{100}a_1$ has a plurality of positioning recesses $\mathbf{100}a_4$ and $\mathbf{100}a_5$ formed at a suitable interval longitudinally along one side surface adjacent a proximal end thereof. Each of the plate members $\mathbf{100}a_1$ and $\mathbf{100}a_2$ has a groove 101 (first engaging structure) in a distal end thereof.

The frame 100*a* defines two mounting bores in a proximal region thereof for receiving flat-head mounting screws 201 to be attached to a guide groove $\mathbf{200}a_1$ of T-shaped section formed in a support member 200*a*. The frame 100*a* is restrained from movement longitudinally thereof by a position setter 202 attached to the support member 200*a* and including a hemispherical portion movable into the positioning recesses $\mathbf{100}a_4$ and $\mathbf{100}a_5$ and a leaf spring for pressing the hemispherical portion into the recesses $\mathbf{100}a_4$ and $\mathbf{100}a_5$. The frame 100*a* is locked against longitudinal movement by a lock screw 203 attached to a bore formed in the support member 200*a* communicating with the guide groove $\mathbf{200}a_1$. Thus, the frame 100*a* is flexibly attached to the support member 200*a* through a flexible support mechanism.

The frame 100*b* includes two plate members $\mathbf{100}b_1$ and $\mathbf{100}b_2$, and a hook engaging mechanism 110 disposed therebetween.

The hook engaging mechanism 110 includes a hook engaging member 110*a*, a wire spring $\mathbf{110}a_3$ (biasing means) for biasing the hook engaging member 110*a* to pivot upward about a pivotal axis 110$a_1$ thereof to move a recessed hook engaging portion 110$a_2$ above the elastic band 50 opposed thereto, and a drive member 111 for causing the hook engaging member 110*a* to pivot downward. The wire spring 110$a_3$ is coiled several times around the pivotal axis 110$a_1$, with one end thereof fixed to a side surface of the hook engaging member 110*a*, and the other end fixed to an inner surface of the plate member 100$b_2$.

As is the frame 100*a*, the frame 100*b* is attached to a guide groove 200$b_1$ of a support member 200*b* by flat-head mounting screws 201, and locked against longitudinal movement by a lock screw 203.

The support members 200*a* and 200*b* define perforations 205*a* and 205*b*, respectively. A pivotal axis 300 (second engaging structure) having opposite end regions of smaller outside diameter than a middle region is connected to one of the support members 200*b* and loosely fitted in the perforation 205*a* of the other support member 200*a*. The pivotal axis 300 has opposite ends projecting from outer surfaces of the support members 200*a* and 200*b* and defining slant surfaces 300*a*, respectively. Alternatively, the engaging pins 21 described in the second embodiment may be employed as the second engaging structure.

Further, the pivotal axis 300 has an inverted V-shaped leaf spring 301 generally following a periphery of the middle region thereof. This leaf spring 301 is engaged at opposite ends thereof with projections 206 on the support members 200*a* and 200*b*. The frames 100*a* and 100*b* are supported to close at distal ends thereof under the elastic restoring force of the leaf spring 301. That is, the leaf spring 301 acts as a frame closing mechanism. In a normal state (not manipulated by hand), therefore, the frames 100*a* and 100*b* are closed at the distal ends as shown in FIG. 20.

The operation of this embodiment will be described with reference to FIGS. 21 through 25.

Figure 21:
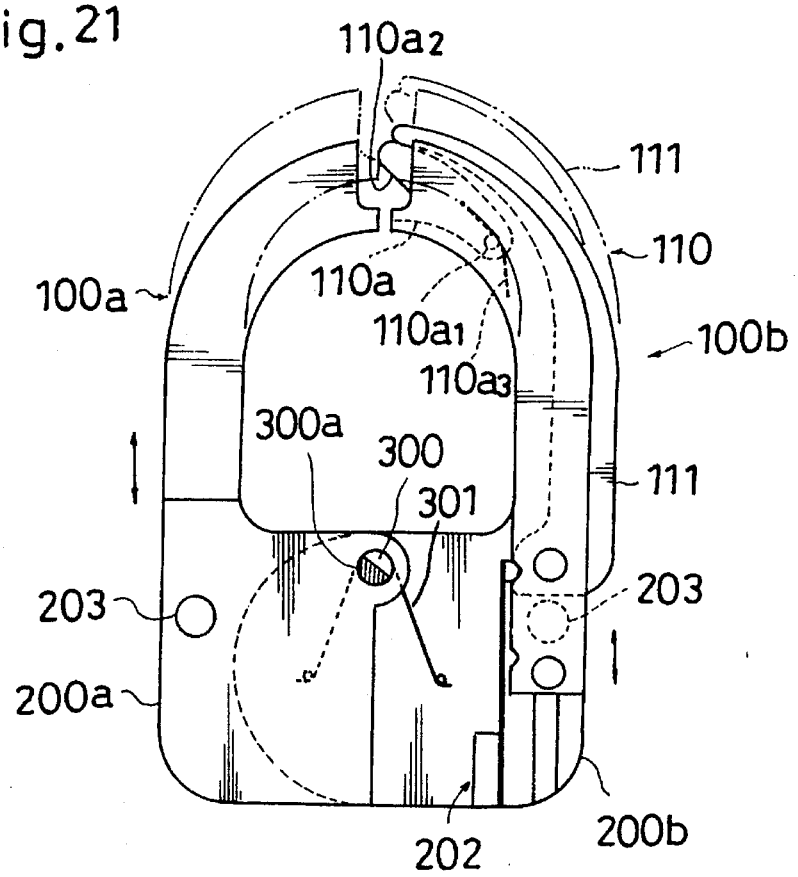
FIG. 21 is a front view of the hair binder in the fifth embodiment.

FIG. 21 is a front view showing the hair binder not manipulated by hand. The frames 100*a* and 100*b* may be longitudinally adjusted relative to the support members 200*a* and 200*b* by loosening the two lock screws 203 and manually pulling or pushing the frames 100*a* and 100*b*. Consequently, as shown in FIG. 22, the frames 100*a* and 100*b* may be opened with the distal ends thereof wide apart to accommodate even a large bulk of hair.

Figure 22:
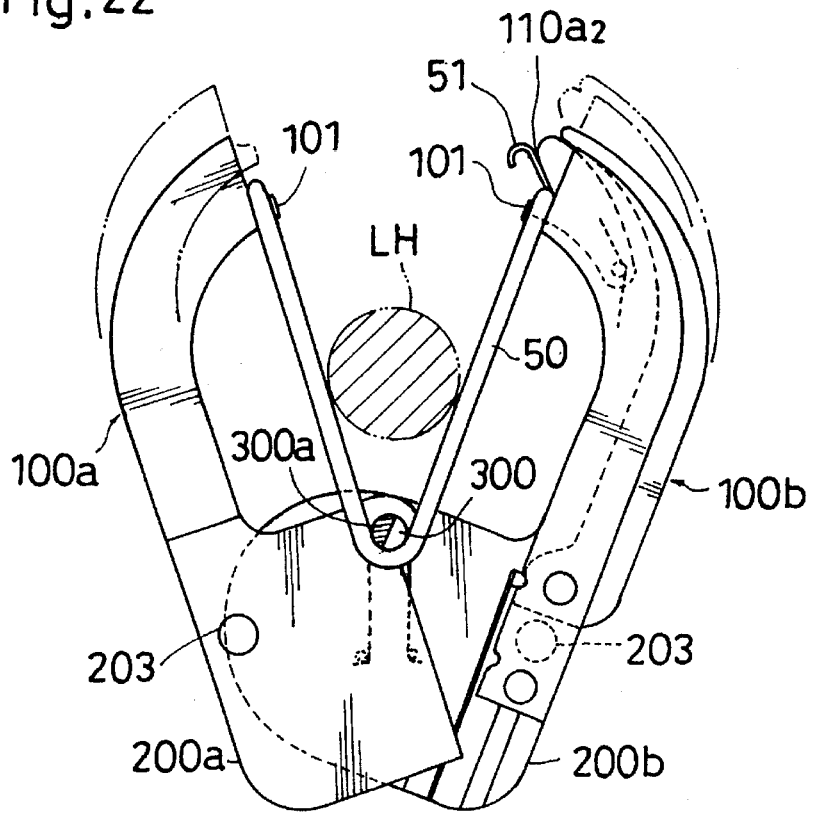
FIG. 22 is an explanatory view of the operation of the hair binder in the fifth embodiment.

FIG. 22 shows the distal ends of the frames 100*a* and 100*b* opened by a manual pressure applied to opposite sides of the support members 200*a* and 200*b*. In this state, the hook 51 is engaged with the hook engaging portion 110$a_2$, portions of the elastic band 50 adjacent the hook 51 are engaged with the grooves 101 of the frame 100*b*, portions of the elastic band 50 opposed to the hook 51 are engaged with the grooves 101 of the frame 100*a*, and intermediate positions of the elastic band 50 are engaged with the pivotal axis 300. In this state, a curved tip end of the hook 51 is directed obliquely upward by the hook engaging portion 110$a_2$ biased upward by the wire spring 110$a_3$. Thus, the curved tip end of the hook 51 lies above a portion of the elastic band 50 opposed thereto.

Figure 23:
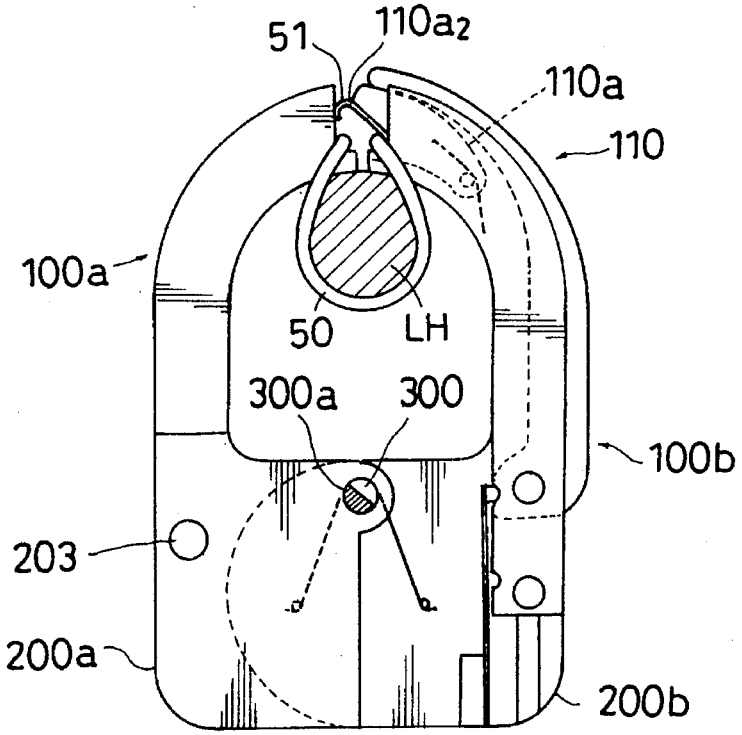
FIG. 23 is an explanatory view of the operation of the hair binder in the fifth embodiment.
Figure 24:
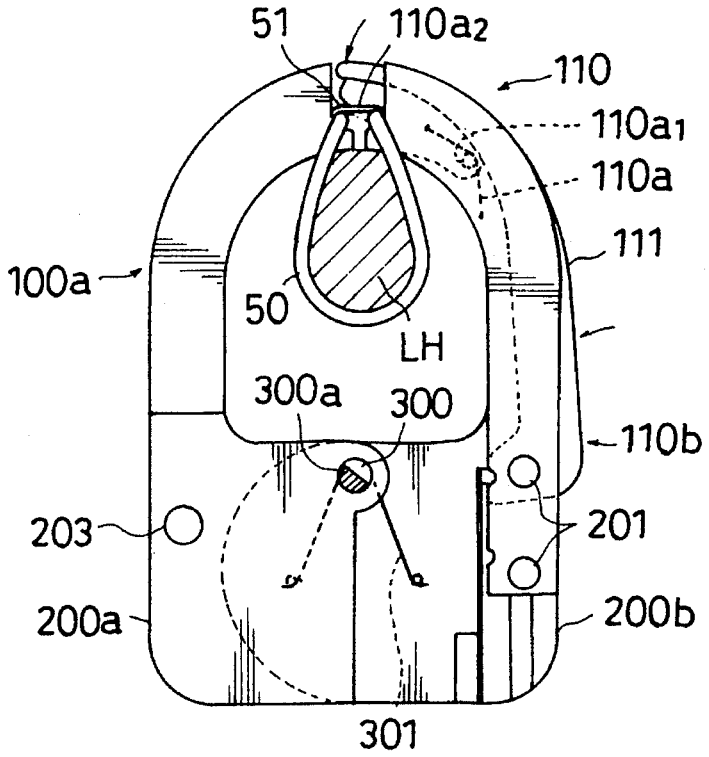
FIG. 24 is an explanatory view of the operation of the hair binder in the fifth embodiment.

Then, the user moves the hair binder to a bunch of long hair LH, and places a selected position of long hair LH through the open distal ends of the frames 100*a* and 100*b*. Next, the manual force applied to the support members 200*a* and 200*b* is relaxed whereby the frames 100*a* and 100*b* begin to close the distal ends under the elastic restoring forces of the leaf spring 301 and elastic band 50. When the opposite ends of the elastic band 50 move adjacent each other with the closure of the frames 100*a* and 100*b*, the elastic band 50 is contacted by the slant surfaces 300*a* of the pivotal axis 300 having rotated with the pivotal movement of the support member 200*b*. As a result, the elastic band 50 stretched in the V-shape slip off the slant surfaces 300*a* under its elastic restoring force, and elastically contracts itself to bind the bunch of long hair LH as shown in FIG. 23.

Next, the hook engaging mechanism 110 is operated to place the curved tip end of the hook 51 on a portion of the elastic band 50 opposed thereto. The hook engaging mechanism 110 is operable by pressing a side surface of the drive member 111 with a thumb or finger. The drive member 111 pivots about one of the mounting screws 201 to lower a distal end thereof. Under the distal end of the drive member 111 is the hook engaging member 110*a* biased upward with the hook engaging portion 100$a_2$ engaging the hook 51. The hook engaging member 110*a* is displaced downward by a lower surface of the distal end of the drive member 111 moving downward. As a result, the hook engaging portion 110$a_2$ is directed downward about the pivotal axis 110$a_1$. With this movement, the curved tip end of the hook 51 engaged in the hook engaging portion 110$a_2$ is caught by the opposed portion of the elastic band 50. The elastic band 50 and hook 51 are now engaged with each other.

Figure 25:
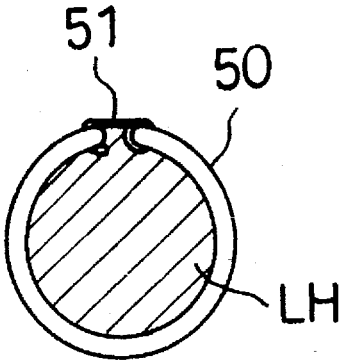
FIG. 25 is an explanatory view of the operation of the hair binder in the fifth embodiment.
Figure 25:
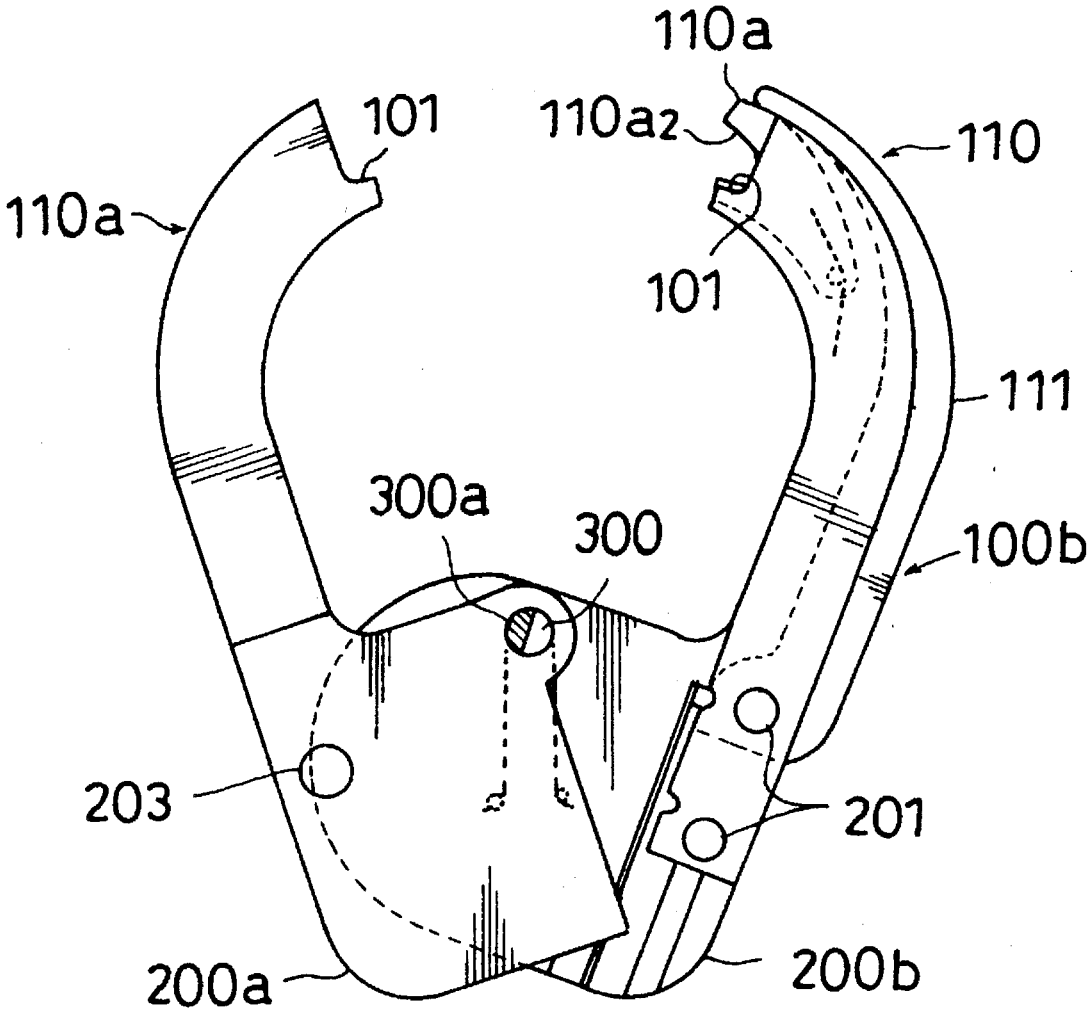

Then, the force applied to the drive member 111 of the hook engaging mechanism 110 is relaxed, and a force is applied to the opposite side surfaces of the support members 200*a* and 200*b* to open the frames 100*a* and 100*b*. As a result, the elastic band 50 and frames 100*a* and 100*b* are separated from each other as shown in FIG. 25.

According to this embodiment, the force applied to the support members 200*a* and 200*b* may simply be relaxed for the leaf spring 301 (frame closing mechanism) to close the frames 100*a* and 100*b* from the open position, thereby allowing a bunch of long hair LH to be bound with ease. The hook engaging mechanism 110 causes the hook 51 to engage the opposite position of the elastic band 50 reliably, thereby allowing the bunch of long hair LH to be bound reliably.

This embodiment has been described, exemplifying the manually operable hook engaging mechanism 110. However, an automatic hook engaging mechanism may be provided instead, which is operable in response to closure of the frames 100*a* and 100*b* to cause the hook 51 to engage the opposite position of the elastic band 50.

Each frame 100*a* (or 100*b*) may be formed of an integral member instead of two plate members 100$a_1$ and 100$a_2$ (or 100$b_1$ and 100$b_2$).

Further, the leaf spring 301 is mounted on the pivotal axis 300 to act as the frame closing mechanism in this embodiment. This mechanism is variable as long as it acts to close the frames 100*a* and 100*b*.

Sixth Embodiment

Figure 26:
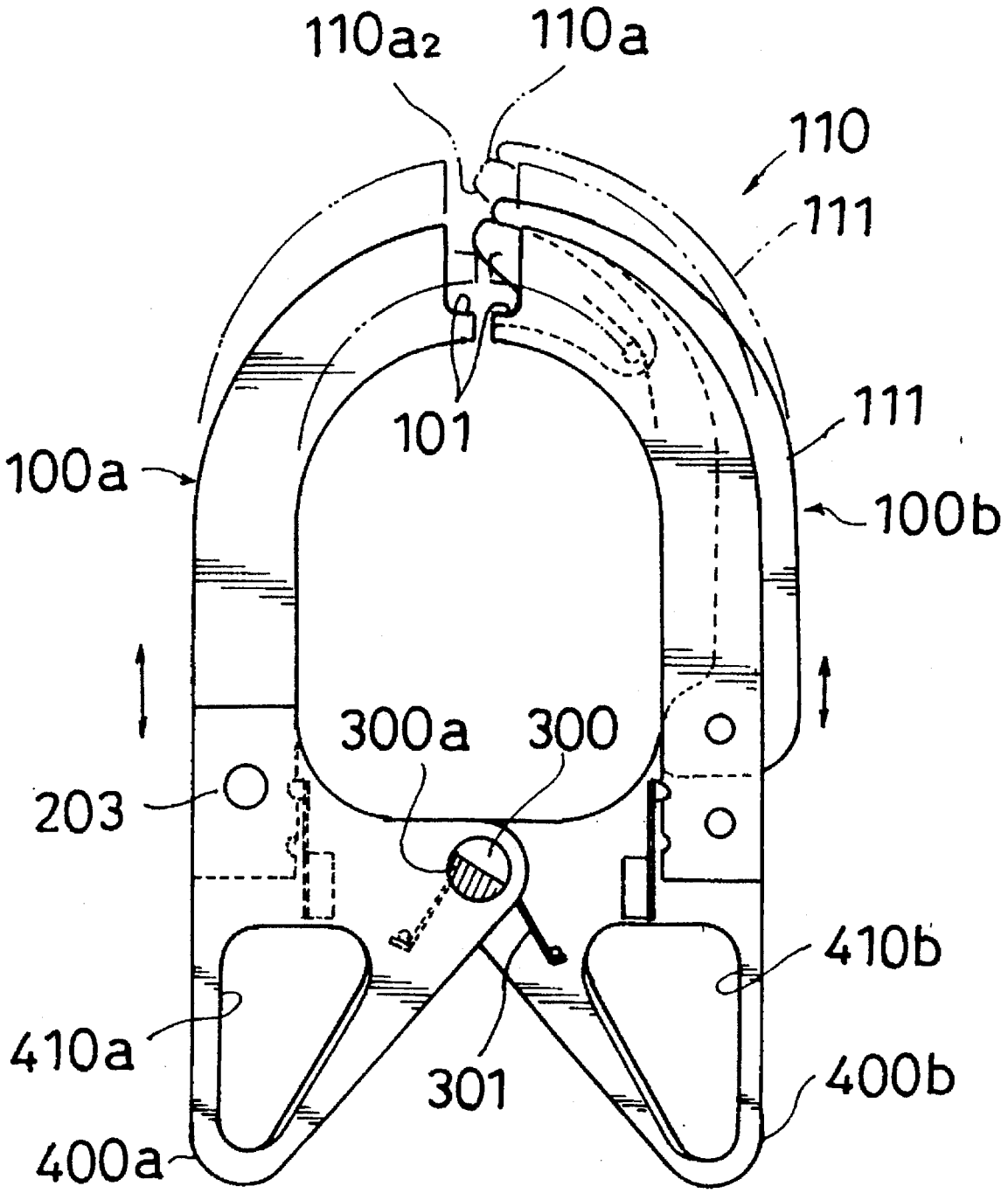
FIG. 26 is a front view of a hair binder in a sixth embodiment of this invention.

FIG. 26 is a front view of a hair binder in this embodiment.

This embodiment differs from the fifth embodiment only in the support members, and only this aspect will be described.

Two support members 400*a* and 400*b* include depending portions defining thumb or finger receiving support openings 410*a* and 410*b* having chamfered inner peripheral surfaces, respectively. For binding a bunch of long hair, the frames 100*a* and 100*b* may be opened, for example, by inserting a thumb into the support opening 410*a* of the support member 400*a* and a first finger into the support opening 410*b* of the support member 400, and drawing the support members 400*a* and 400*b* closer together. These support openings 410*a* and 410*b* are effective for allowing the thumb and finger to hold the support members 400*a* and 400*b* steadily without slipping therefrom. Thus, a hair binding operation may be carried out in a stable way.

In each of the described embodiments, the elastic band is used in duplex to bind a bunch of long hair. Instead, the elastic band may be used in simplex or triplex for the hair binding purposes.

The present invention may be embodied in other specific forms without departing from the spirit or essential attributes thereof and, accordingly, reference should be made to the appended claims, rather than to the foregoing specification, as indicating the scope of the invention.

What is claimed is:

1. A hair binder for a bunch of binding long hair, comprising:

an elastic hair band;

a pair of frames joined at proximal ends thereof for opening and closing relative to each other, said frames forming a circle when closed;

a first engaging structure disposed at distal ends of said pair of frames for engaging opposite ends of said band; and a second engaging structure disposed at said proximal ends for engaging intermediate positions of said band when said frames are opened, and releasing said intermediate positions when said frames are closed.

2. A hair binder as defined in claim 1, wherein said second engaging structure comprises a pivotal axis projecting from said proximal ends and connected to one of said frames for allowing opening and closing of said frames, said pivotal axis having projecting opposite ends thereof defining slant surfaces, respectively, for allowing said intermediate positions of said band to slip out of engagement therewith.

3. A hair binder as defined in claim 1, wherein said second engaging structure includes engaging pins each mounted with a coil spring in a stepped bore formed in a friction surface of the proximal end of one of said frames, with a distal end of each engaging pin being projectable from an outer surface of one of said frames, the friction surface of the proximal end of the other frame defining a recess for receiving a proximal end of said engaging pin when said frames are closed.

4. A hair binder as defined in claim 1, wherein said first engaging structure is constructed for removably securing at least one end of said band and for allowing adjustment of band length.

5. A hair binder as defined in claim 1, wherein said band is ring-shaped with a hook attached to a position thereof, said first engaging structure including grooves formed in said frames for loosely engaging said position of said band to which said hook is attached and a position of said band opposed to said hook, respectively, said hook engaging said position of said band opposed thereto to separate said band and said frames from each other when said frames are closed.

6. A hair binder for binding a bunch of long hair, comprising:

an elastic hair band in ring form;

a hook attached to a position of said band;

a pair of frames for presenting an inverted U-shape when closed;

a first engaging structure including grooves formed at distal ends of said pair of frames for loosely engaging said position of said band to which said hook is attached and a position of said band opposed thereto, said hook engaging said position of said band opposed thereto to separate said band and said frames from each other;

a pair of support members for supporting proximal ends of said frames, respectively, to be pivotable open and close about a predetermined pivoting center; and a second engaging structure disposed at said pivoting center for engaging intermediate positions of said band when said frames are opened, and releasing said intermediate positions when said frames are closed.

7. A hair binder as defined in claim 6, wherein said pair of support members include flexible support mechanisms for flexibly supporting said frames, respectively.

8. A hair binder as defined in claim 7, wherein each of said flexible support mechanisms includes a guide groove of T-shaped section formed in one of said support members, flat-head mounting screws slidable along said guide groove and connected to one of said frames, and a position setter for restraining one of said frames from sliding along said guide groove.

9. A hair binder as defined in claim 6, wherein said frames include a hook engaging mechanism for causing said hook to engage said position of said band opposed thereto when said frames are closed.

10. A hair binder as defined in claim 9, wherein said hook engaging mechanism includes a hook engaging member having a recessed hook engaging portion for engaging said hook, a pivotal axis for allowing said hook engaging portion to move to a position opposed to said hook, biasing means for biasing said hook engaging portion above a position of said band opposed to said hook, and a drive member for causing a pivotal movement of said hook engaging member.

11. A hair binder as defined in claim 6, wherein said second engaging structure comprises a pivotal axis projecting from said support members at said pivoting center and connected to one of said support members for allowing opening and closing of said frames, said pivotal axis having projecting opposite ends thereof defining slant surfaces, respectively, for allowing said intermediate positions of said band to slip out of engagement therewith.

12. A hair binder as defined in claim 6, wherein said second engaging structure includes engaging pins each mounted with a coil spring in a stepped bore formed in a friction surface adjacent said pivoting center of one of said support members, with a distal end of each engaging pin being projectable from an outer surface of one of said frames, the friction surface of the other support member defining a recess for receiving a proximal end of said engaging pin when said frames are closed.

13. A hair binder as defined in claim 6, wherein said support members include a frame closing mechanism for closing said distal ends of said frames in a normal state.

14. A hair binder as defined in claim 13, wherein said frame closing mechanism includes an inverted V-shaped leaf spring with a middle portion thereof placed at said pivoting center of said support members, and projections formed on said support members to engage opposite ends of said leaf spring, respectively.

15. A hair binder as defined in claim 6, wherein said support members define finger receiving openings, respectively.

* * * * *